US007127765B2

(12) United States Patent
Ruiz

(10) Patent No.: US 7,127,765 B2
(45) Date of Patent: Oct. 31, 2006

(54) CORNER PIECE FOR MATTRESSES AND THE PRODUCTION METHOD THEREOF

(75) Inventor: Tomas Romero Ruiz, Madrid (ES)

(73) Assignee: Flex Equipos de Descanso,S.A., Madrid (ES)

( * ) Notice: Subject to any disclaimer, the term of this patent is extended or adjusted under 35 U.S.C. 154(b) by 105 days.

(21) Appl. No.: 10/502,033

(22) PCT Filed: Jan. 21, 2003

(86) PCT No.: PCT/ES03/00027

§ 371 (c)(1),
(2), (4) Date: Oct. 28, 2004

(87) PCT Pub. No.: WO03/059126

PCT Pub. Date: Jul. 24, 2003

(65) Prior Publication Data

US 2005/0050639 A1 Mar. 10, 2005

(30) Foreign Application Priority Data

Jan. 21, 2002 (ES) ..... 200200117

(51) Int. Cl.
*A47C 23/04* (2006.01)
*A47C 31/00* (2006.01)

(52) U.S. Cl. ..... 5/739; 5/717

(58) Field of Classification Search ..... 5/739, 5/717, 716, 690, 655.7; 29/446, 452, 896.9, 29/896.93
See application file for complete search history.

(56) References Cited

U.S. PATENT DOCUMENTS 2,927,330 A * 3/1960 Koenigsberg ..... 5/717
3,401,411 A 9/1968 Morrison
6,263,533 B1 * 7/2001 Dimitry et al. ..... 5/717

FOREIGN PATENT DOCUMENTS

DE 1 529 605 11/1971
FR 1 575 189 9/1969

OTHER PUBLICATIONS

PCT Publication Application No. WO 92/16128, published Oct. 1, 1992.

* cited by examiner

*Primary Examiner*—Alexander Grosz
(74) *Attorney, Agent, or Firm*—Fulwider Patton LLP

(57) ABSTRACT

Specifically conceived for mattresses with springs (4), the mattress consists of a cylindrical tubular body (1, 1') with a longitudinal cut line (2) in correspondence with one of its lines of symmetry, that connects its two open ends, towards which open a number of wide notches (3, 3'), with an isosceles trapezoid configuration that, together with the longitudinal opening (2) allow the male-female coupling of the corner piece to the springs (4) of the mattress, externally closing the set of springs at the corresponding corner to provide a smooth, continuous surface without any bulges, recesses or deformations.

7 Claims, 3 Drawing Sheets

CORNER PIECE FOR MATTRESSES AND THE PRODUCTION METHOD THEREOF

RELATED APPLICATIONS

This application is a U.S. national phase of PCT/ES03/00027, filed 21 Jan. 2003, which claims priority from Spanish Application Serial No. P200200117, filed Jan. 21, 2002.

OBJECT OF THE INVENTION

The present invention relates to a piece that has been specifically conceived to be used as a corner piece at each vertex or corner of a mattress, particularly suitable for being used in spring mattresses, so that it shares the elastically deformable nature of the mattress core and is easily attachable to the corners of the mattress, preventing the typical bulges, recesses or deformations that generally appear in these areas of spring mattresses.

BACKGROUND OF THE INVENTION

Mattresses of the aforementioned type generally comprise a spring casing in which a number of spring units, generally helical in shape, are suitably connected to each other while being disposed between to imaginary planes parallel to the bases of the mattress. More specifically, these spring units are coplanar on their ends, where they are attached to padded bodies that line the core of the mattress on its top and bottom, softening the physical contact with said springs and thereby increasing the comfort of the mattress for the user.

A similar padded lining is present around the entire perimeter of the mattress, where the result is less effective as the deformability of these areas is greater, particularly so in the corners, where bulges, recesses, deformations or wrinkles often appear that harm the appearance of the mattress.

DESCRIPTION OF THE INVENTION

The corner piece for mattresses disclosed by the invention solves the above-described problem in a fully satisfactory manner, and consists of a tubular body made of polyethylene, equal in length to the thickness of the spring core of the mattress, with deep notches established at its open ends and a longitudinal slit along one of its lines of symmetry, so that this polyethylene part can adapt itself and be attached to the springs of the mattress at its corners, providing at each corner an externally smooth and perfectly cylindrical surface that reduces the elastic deformability of the mattress at the corresponding corner, while also greatly enhancing its appearance.

As regards the method for constructing said polyethylene corner piece, it involves using a tubular cylindrical part obtained by extrusion, which is cut along one of its lines of symmetry allowing it to be extended, to turn it into a laminar flat body in the cutting stage in which the end notches are obtained, finally recovering its original three-dimensional or cylindrical shape by simple elastic recovery of its material.

DESCRIPTION OF THE DRAWINGS

As a complement of the description being made, in order to aid a better understanding of the characteristics of the invention, according to an example of a preferred embodiment, the present description is accompanied by a set of drawings as an integral part of it where, for purposes of illustration only and in a non-limiting sense, the following is shown.

PREFERRED EMBODIMENT OF THE INVENTION

Figure 1:
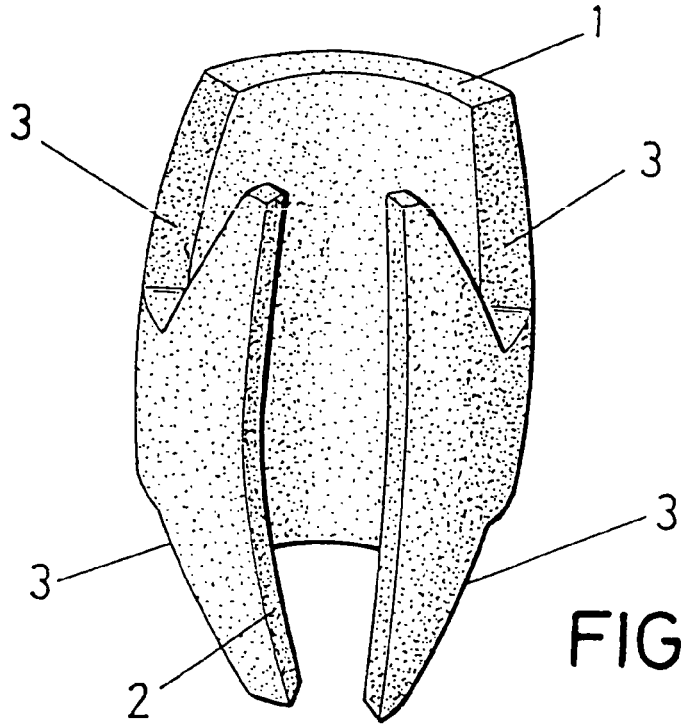
FIG. 1 shows a perspective view of a mattress corner piece made in accordance with the object of the present invention.
Figure 2:
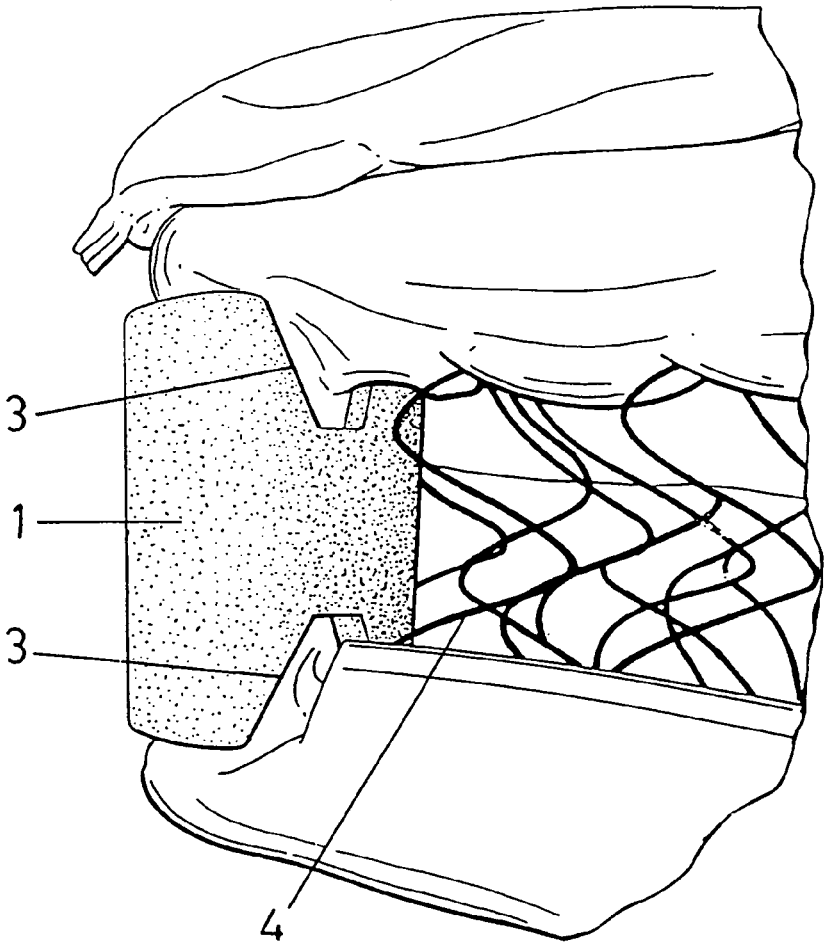
FIG. 2 also shows a perspective view of the corner piece of the previous figure, duly coupled on one of the corners of a spring mattress.
Figure 3:
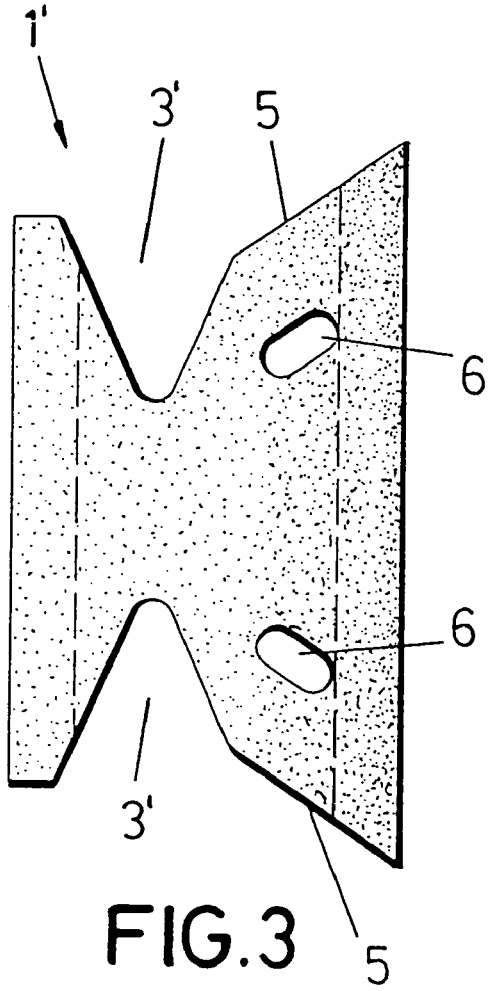
FIGS. 3, 4 and 5 show, respectively, a profile, elevation and plan view of another preferred embodiment of the invention.
Figure 4:
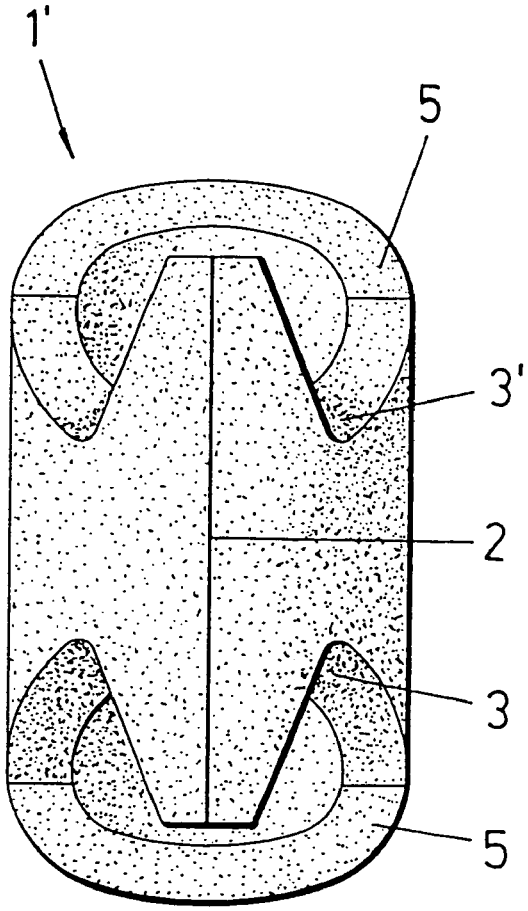
Figure 5:
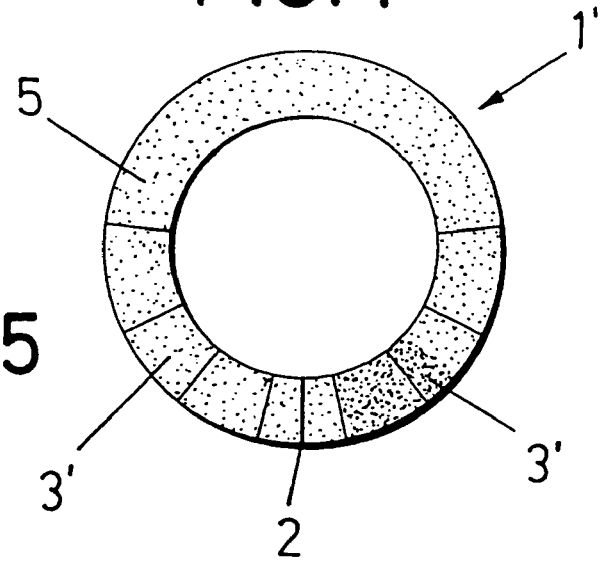
Figure 6:
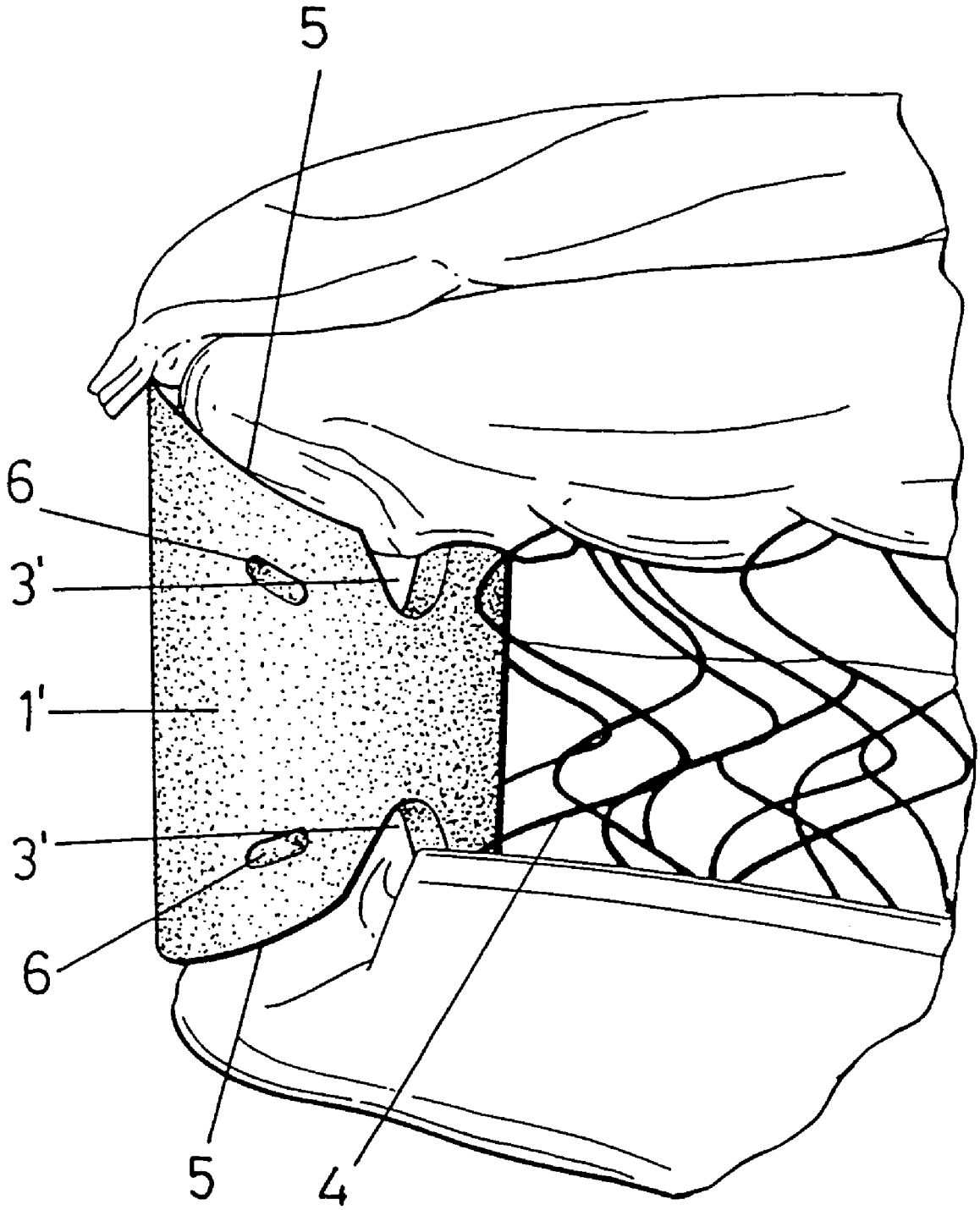
FIG. 6 shows, finally, a perspective view of the same corner piece of the previous figure duly coupled on each of the corners of a spring mattress.

In view of the above-described figures, it can be seen that the corner piece for mattresses disclosed by the invention is comprised of a tubular body (1), preferably of polyethylene and obtained by extrusion, with a configuration tending towards a cylinder and a considerable wall thickness, the tubular body (1) being open by a longitudinal slit (2) placed in correspondence with one of its lines of symmetry, to allow by means of its elastic deformation to temporarily convert it into a laminar flat body that in a cutting stage is provided with large notches (3) on its ends, preferably having the isosceles trapezoid shape particularly visible in FIG. 2, so that at the end of this cutting stage for obtaining the notches (3), the elastic recovery of the body (1) makes it regain its original tubular or three-dimensional configuration, as in either FIG. 1 or 2.

The axial length of the tubular body (1) shall be that suitable for the thickness of the mattress, as can be inferred from FIG. 2, and the notches (3) of its ends are meant to facilitate, together with the longitudinal slit (2), the coupling of the corner piece to the springs (4) that participate in the mattress, each corner piece (1) naturally being placed at each vertical edge of the mattress, helping to elastically stiffen said edges as they cover their surface and provide an aesthetic finish, as well as helping prevent their deformation.

Likewise, in another preferred embodiment of the invention a tubular body (1') is provided with a configuration tending towards a cylinder as in the previous case, also preferably made of polyethylene and obtained by extrusion, the tubular body (1') also being open by a longitudinal slit (2) placed in correspondence with one of its lines of symmetry.

However, in this embodiment the tubular body (1') is provided with notches (3') on its ends, preferably having an isosceles trapezoid configuration with an oblique cut, truncation or bevel (5) at the vertices corresponding to the greater base of the trapezoid located farthest away from the longitudinal slit, as shown in FIGS. 3 to 6, which allow improving the flexion of the tubular body and thus of the corners of the mattress, so that their stiffness is close to or similar to that of the rest of the mattress. In addition, under and near said bevels (5) the body (1') has cut-outs or orifices (6) that aid in the deformation or flexion of the body (1') in a vertical sense, due to the presence of a narrow strip between the upper edge of the body (1') and the aforementioned cut-outs (6) that flexes easily.

The invention claimed is:

1. An article which is able to be associated with a spring mattress which is deformable, wherein the spring mattress includes a spring core including corner springs, and wherein the article comprises a corner piece which is able to be attached to a corner spring, the corner piece comprising:

a generally tubular body (1, 1'), the length of which is generally equal to the thickness of the spring core, having lines of symmetry, and including a slit (2) along one of the lines of symmetry, said generally tubular body having opposing open ends, and at least one notch (3, 3'), at the opposing open ends, able to be attached to the corner spring, so as to reduce the deformability of the mattress at the location of the corner piece.

2. An article as in claim 1, wherein the generally tubular body is generally cylindrical in shape.

3. An article as in claim 1, wherein the generally tubular body is comprised of polyethylene.

4. An article as in claim 1, wherein the at least one notch includes a vertex at a farthest distance away from said slit (2), and the corner piece has an oblique cut (5) at the vertex.

5. An article as in claim 4, further having cut-outs under the oblique cut (5), which enable flexion of the generally tubular body.

6. A method of forming an article which is able to be associated with a spring mattress which is deformable, wherein the spring mattress includes a spring core including corner springs, and wherein the article comprises a corner piece which is able to be attached to a corner spring, the corner piece comprising a generally tubular body, the length of which is generally equal to the thickness of the spring core, having lines of symmetry, and including a slot along one of the lines of symmetry, forming an open end, and at least one notch, able to be attached to the corner spring, so as to reduce the deformability of the mattress at the location of the corner piece, wherein the method comprises:

forming the generally tubular body which is resilient;

forming the slot along the one of the lines of symmetry so as to form the open end;

forming the notch at the open end so as to flatten the generally tubular body; and enabling the flattened generally tubular body to resiliently return from the flattened form thereof to the generally tubular form thereof.

7. A method as in claim 6, wherein forming the generally tubular body comprises extruding thereof.

* * * * *